US010662830B2

(12) United States Patent
Riley

(10) Patent No.: US 10,662,830 B2
(45) Date of Patent: May 26, 2020

(54) DYNAMIC LOCKING AND RELEASING CAM LOBE

(71) Applicant: Yelir, Inc., Fort Collins, CO (US)

(72) Inventor: Michael B. Riley, Fort Collins, CO (US)

(73) Assignee: Yelir, Inc., Fort Collins, CO (US)

( * ) Notice: Subject to any disclaimer, the term of this patent is extended or adjusted under 35 U.S.C. 154(b) by 0 days.

(21) Appl. No.: 15/874,693

(22) Filed: Jan. 18, 2018

(65) Prior Publication Data

US 2018/0209313 A1 Jul. 26, 2018

Related U.S. Application Data

(60) Provisional application No. 62/448,521, filed on Jan. 20, 2017.

(51) Int. Cl.

| | |
|---|---|
| ***F01L 1/34*** | (2006.01) |
| ***F01L 13/00*** | (2006.01) |
| ***F01L 1/047*** | (2006.01) |

(52) U.S. Cl.

CPC ..... *F01L 13/0005* (2013.01); *F01L 1/047* (2013.01); *F01L 2001/0471* (2013.01); *F01L 2001/0473* (2013.01)

(58) Field of Classification Search

CPC ..... F01L 1/047; F01L 13/0005; F01L 2001/0471; F01L 2001/0473

USPC ..... 123/90.15, 90.17, 90.6, 90.16, 90.44

See application file for complete search history.

(56) References Cited

U.S. PATENT DOCUMENTS

| | | | |
|---|---|---|---|
| 4,788,946 A | 12/1988 | Inoue et al. | |
| 5,603,293 A | 2/1997 | Schwarzenthal et al. | |
| 6,557,518 B1 | 5/2003 | Albertson et al. | |
| 7,036,473 B1 | 5/2006 | Goracy | |
| 7,503,296 B2 | 3/2009 | Rozario et al. | |
| 8,631,775 B2 * | 1/2014 | Klingbeil | F01L 1/26 123/90.16 |

* cited by examiner

*Primary Examiner* — Ching Chang

(74) *Attorney, Agent, or Firm* — Regan L. Trumper; Cochran Fruend & Young LLC

(57) ABSTRACT

Disclosed is a method and system for intermittently operating poppet valves in an internal combustion engine when desired by the selective locking or unlocking of one or more cam lobes with the camshaft. One or more cam lobes, with a small radial clearance, ride on a camshaft such that an engagement mechanism may be activated as desired to lock the cam lobe to the camshaft, thereby activating the respective poppet valve. The cam lobe is prevented from moving axially to ensure correct alignment with a follower. A suitable holding device may be used to ensure the non-activated cam lobes are restrained at a suitable orientation relative to the cam follower.

2 Claims, 4 Drawing Sheets

DYNAMIC LOCKING AND RELEASING CAM LOBE

BACKGROUND OF THE INVENTION

Numerous attempts to develop systems of variable valve actuation have focused either upon the rocker arm, or on the lifter. For instance, ways to lock components of multiple piece rocker arms together to allow operation of specific cam lobes (low lift, low duration, or high lift, high duration) on a single valve have been attempted. Others have used a rigid, collapsing follower to allow actuation of the connected valve in one mode, or allow the valve to remain closed in another.

These designs typically require the use of an additional spring return to ensure the follower maintains contact with the cam lobe as the cam engages the follower continuously. A simple system for allowing dynamic engagement or disengagement of a cam lobe on the camshaft would eliminate the need for additional hardware to control unneeded motion.

SUMMARY OF THE INVENTION

An embodiment of the present invention may therefore comprise: a cam driven reciprocating internal combustion engine comprising: a cylinder block defining a plurality of cylinders, each of the cylinders in mechanical communication with a respective cam driven intake valve and/or exhaust valve; a rotating camshaft in mechanical communication with at least one selectively disengageable cam lobe; the cam lobe that when mechanically coupled to the camshaft, controls the operation of the respective intake valve and/or the respective exhaust valve; at least one coupler that selectively couples and decouples the rotational force of the camshaft to at least one respective cam lobe; at least one cam lobe that is rotationally disengaged and uncoupled from the rotation of the camshaft in a first mode thereby deactivating the respective valve, and the cam lobe that is rotationally engaged and coupled with respect to the rotation of the camshaft in a second mode thereby activating the respective valve; and, a controller that sends a signal to at least one of the couplers to rotationally disengage the respective valve during operation of the internal combustion engine.

An embodiment of the present invention may also comprise: a system for deactivating one or more valves of a reciprocating internal combustion engine during operation comprising: a rotating camshaft in mechanical communication with a plurality of cam lobes, each of the cam lobes that is mechanically coupled to, and controls the operation of, an intake valve or an exhaust valve associated with a respective cylinder of the internal combustion engine; at least one coupler that selectively couples the rotational force of the camshaft to at least one respective cam lobe; at least one cam lobe that is selectively rotationally disengaged and uncoupled from the rotation of the camshaft by the coupler in a first mode, thereby deactivating the respective valve from undergoing gas exchange during at least one cycle of the operation of the internal combustion engine, and at least one cam lobe that is rotationally engaged and coupled with respect to said rotation of the camshaft by the coupler in a second mode thereby activating the respective valve during at least one cycle of the operation of the internal combustion engine; and, a controller that sends a signal to at least one coupler to rotationally disengage the respective valve during operation of the internal combustion engine.

An embodiment of the present invention may also comprise: a method of deactivating one or more valves from undergoing gas exchange during the operation of an internal combustion engine comprising the steps: providing a cam driven reciprocating internal combustion engine comprising; a cylinder block defining a plurality of cylinders, each said cylinder in mechanical communication with a respective cam driven intake valve and exhaust valve; rotating a camshaft in mechanical communication with at least one selectively disengageable cam lobe thereby controlling the operation of said respective intake valve or said respective exhaust valve; providing at least one coupler that selectively couples and decouples the rotational force of the camshaft to at least one respective cam lobe; deactivating the respective valve by signaling at least one coupler to selectively rotationally disengage and uncouple the respective cam lobe from the rotation of the camshaft in a first mode; and, activating the respective valve by signaling at least one coupler to rotationally engage and couple with respect to the rotation of the camshaft in a second mode.

DETAILED DESCRIPTION OF THE INVENTION

Figure 1:
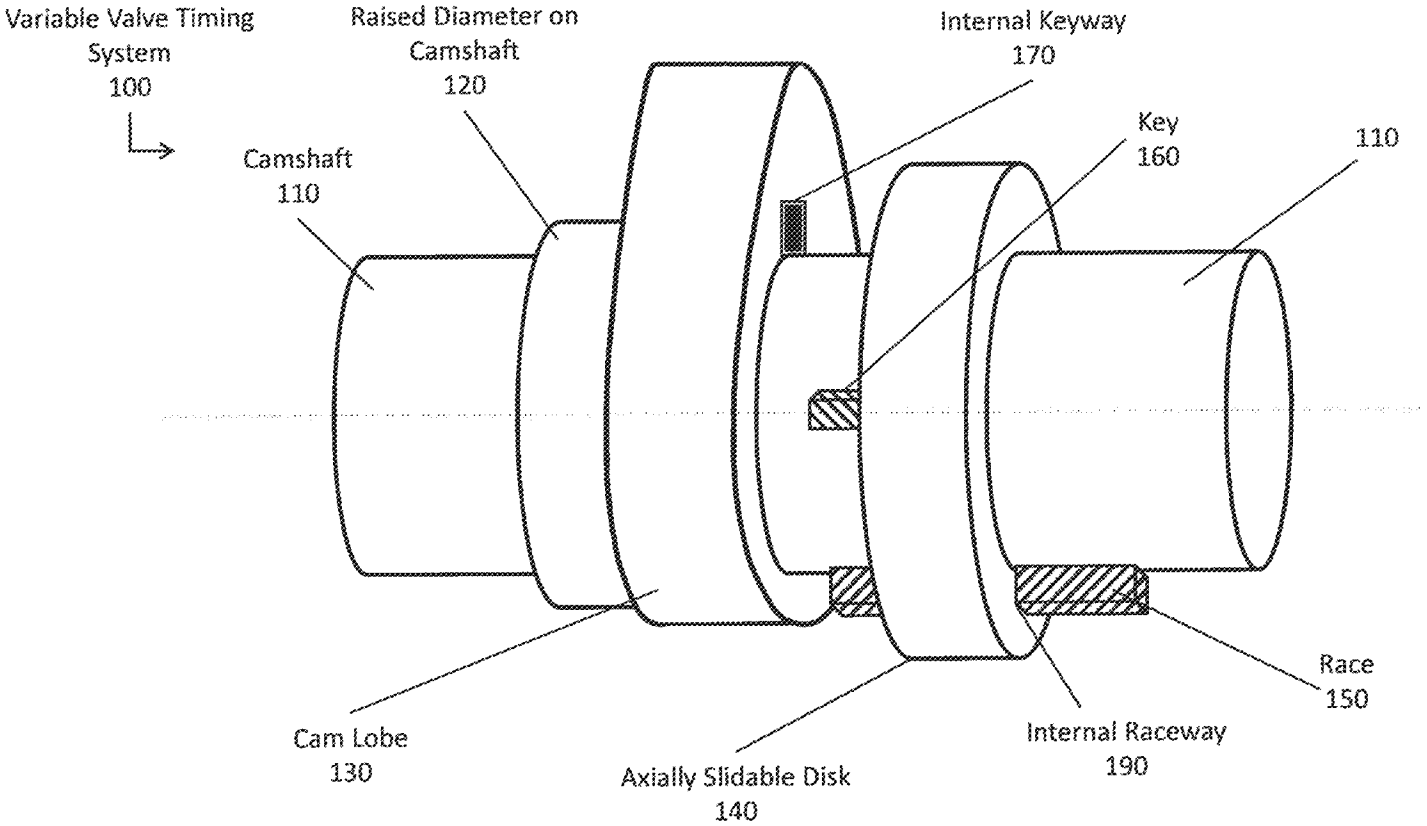
FIG. 1 illustrates an embodiment of a dynamic locking and releasing cam lobe system.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

FIG. 1 is an embodiment of a dynamic locking and releasing cam lobe system. In this embodiment, a system for allowing dynamic engagement or disengagement of the cam lobe on the camshaft is disclosed. As shown in FIG. 1, one or more of the lobes on a camshaft of the combustible engine or the like is adjustable to enable activation or deactivation of the intake and exhaust valves dynamically, e.g. without the need to replace or modify the camshaft, and without having to stop engine operation to achieve the activation or deactivation. As a common mechanism the camshaft is a mechanical device that converts rotary motion into linear motion.

In an internal combustion engine, the camshaft opens and closes intake and exhaust valves letting the air/fuel mixture into the cylinder and allowing the exhaust to exit. The camshaft includes cam lobes which lift the valves, wherein the greater the elevation of the lobe from its base circle, the higher the opening, which may allow more air/fuel into the engine and more exhaust out. The height of the lobe, or the distance it opens the valve, is known as the lift. The angular eccentricity of the lobe determines the angle relative to the crankshaft cycle the valves are kept open. This is known as the duration, and is typically given in degrees of crankshaft rotation.

In instances where a low output is desired, the ability to regulate and prevent gas exchange in certain cylinders every cycle may prove beneficial to the overall performance and efficiency of the system. One way this can be achieved is by utilizing a variable valve timing system where certain cylinders undergo gas exchange for example on every second, third or fourth cycle, or are infinitely adjustable to undergo gas exchange or be disabled at will.

FIG. 1 exemplifies a variable valve timing system 100 where a camshaft 110 contains a raised diameter 120 and a cam lobe 130 that may rotate independent of the camshaft 110. This cam lobe 130 may be dynamically engaged and disengaged from the rotation of the camshaft 110 by utilizing an internal keyway 170 within the cam lobe 130 that integrates with a key 160 fixed to a slidable disk 140 positioned on the camshaft 110.

The slidable disk 140 is positioned on the camshaft 100 to be fixed with respect to the rotation of the shaft, but is variable with respect to the axial positioning on the shaft. This is accomplished in this embodiment utilizing a race 150 that is fixed to the surface of the camshaft 100 and allows the axially slidable disk 140 to move a limited amount in the axial direction to engage and disengage the key 160 into, and out of the internal keyway 170 on the on the cam lobe 130. The axially slidable disk 140 is constrained axially by the camshaft and rotationally by the race 150. A small amount of translation in the axial direction is provided by the interaction between the race 150 and an axially oriented raceway 190 positioned through the axially slidable disk 140.

In this manner, the cam lobe 110 has two distinct states of interaction with the valve. In one state, the axially slidable disk 140 is positioned as shown in FIG. 1, and the key 160 disengaged from the internal keyway 170, whereby the cam lobe 130 is free and can be held stationary while the camshaft 110 rotates. The valve that this cam lobe operates on would then remain closed, preventing gas exchange through that valve.

Figure 2:
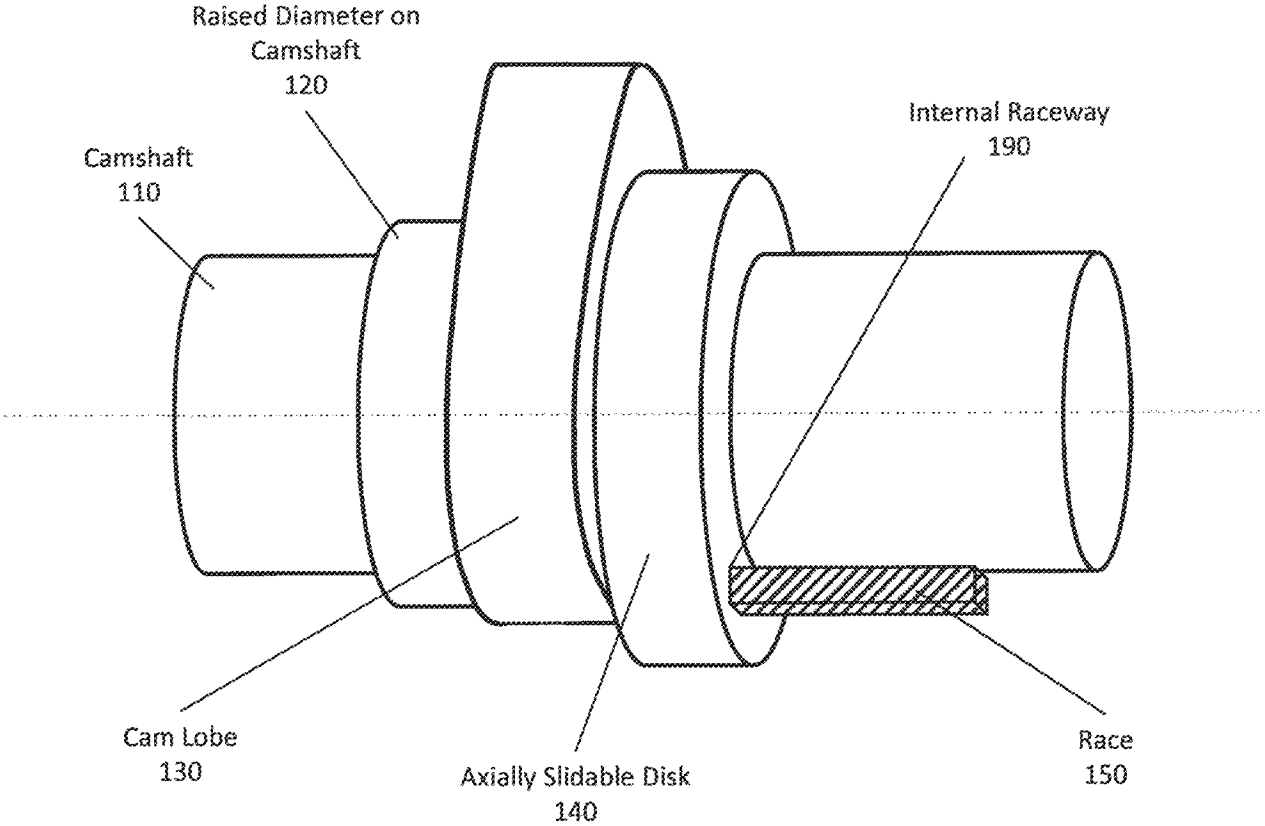
FIG. 2 illustrates an embodiment of a dynamic locking and releasing cam lobe system.

In another state, the axially slidable disk 140 is positioned as shown in FIG. 2, and the key 160 is engaged with the internal keyway 170 thereby placing the cam lobe 130 in a locked position with respect to the camshaft 110. This allows the engine to undergo gas exchange on all valves whose cam lobes are engaged with the camshaft 110.

An axial slide engagement mechanism rotating with the camshaft may be utilized to engage and lock the cam lobe 130 with the camshaft 110 at the desired rotational angle. Such a mechanism may be electromagnetically or hydraulically actuated, with return springs to provide the opposite force requirement. This system may be engaged by default (inactivated) and disengaged when the activation force is applied, or vice versa.

Figure 3:
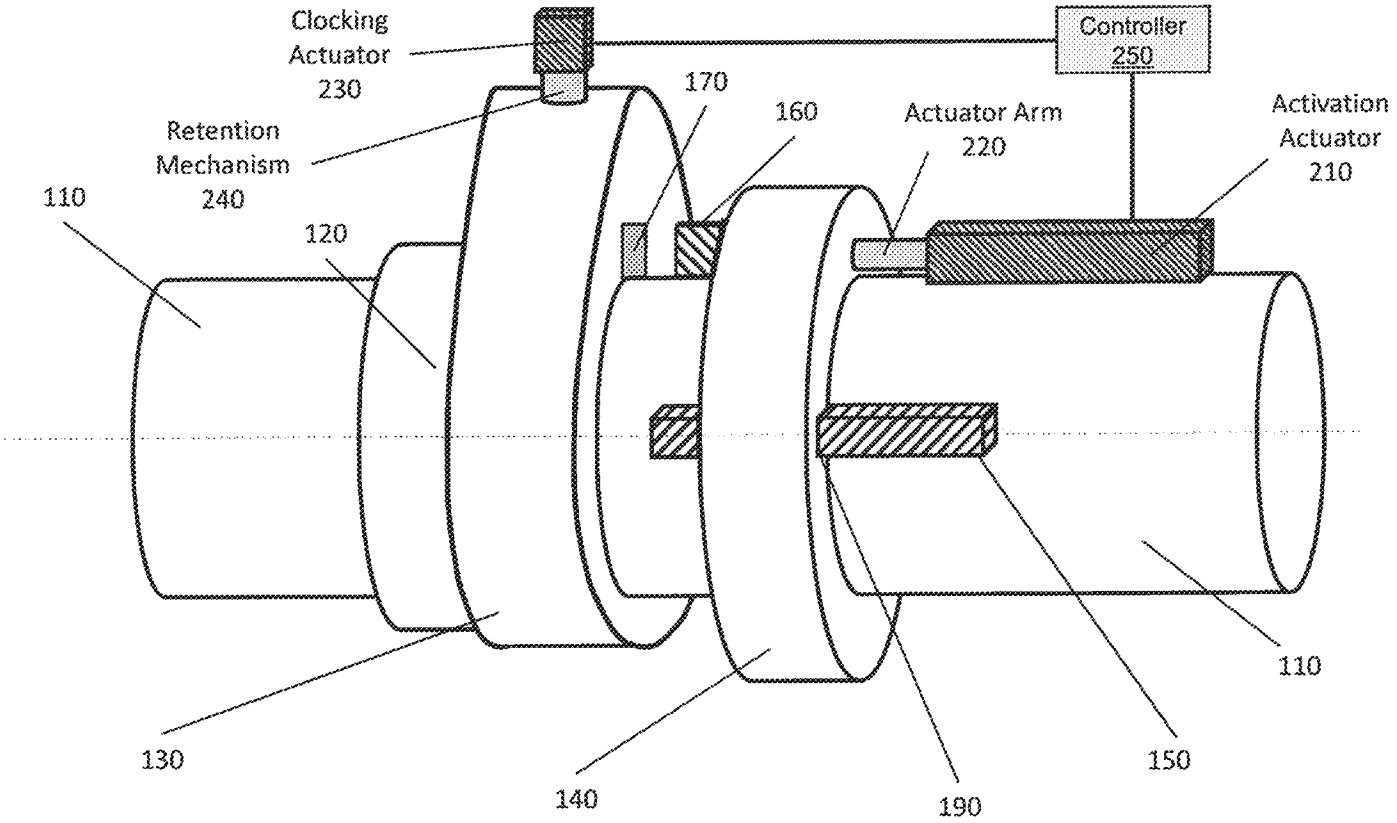
FIG. 3 illustrates an embodiment of an actuating dynamic locking and releasing cam lobe system.

FIG. 3 discloses such a mechanism where an activation actuator 210, rotating with the camshaft 110 is able to transmit force to the axially slidable disk 140 via an actuator arm 220. As depicted in FIG. 3, the actuator is in an inactive state, and the cam lobe 130 is independent and not rotating with the camshaft 110. In this state, the cam lobe is not activated, and the valve(s) associated with this cam lobe 130 are inactive. This allows the particular valves fitted with this system to be inactivated very quickly and essentially at-will, in any engine cycle, and provides versatility in engine performance. The activation and timing of the activation actuator 210 and the clocking actuator 230 may be controlled by a controller 250. This controller may utilize mechanical, hydraulic, electric or optical signals to be passed to the actuators. The controller may be microprocessor or logic driven and finely coordinated and tailored to the desired engine load or demand.

Figure 4:
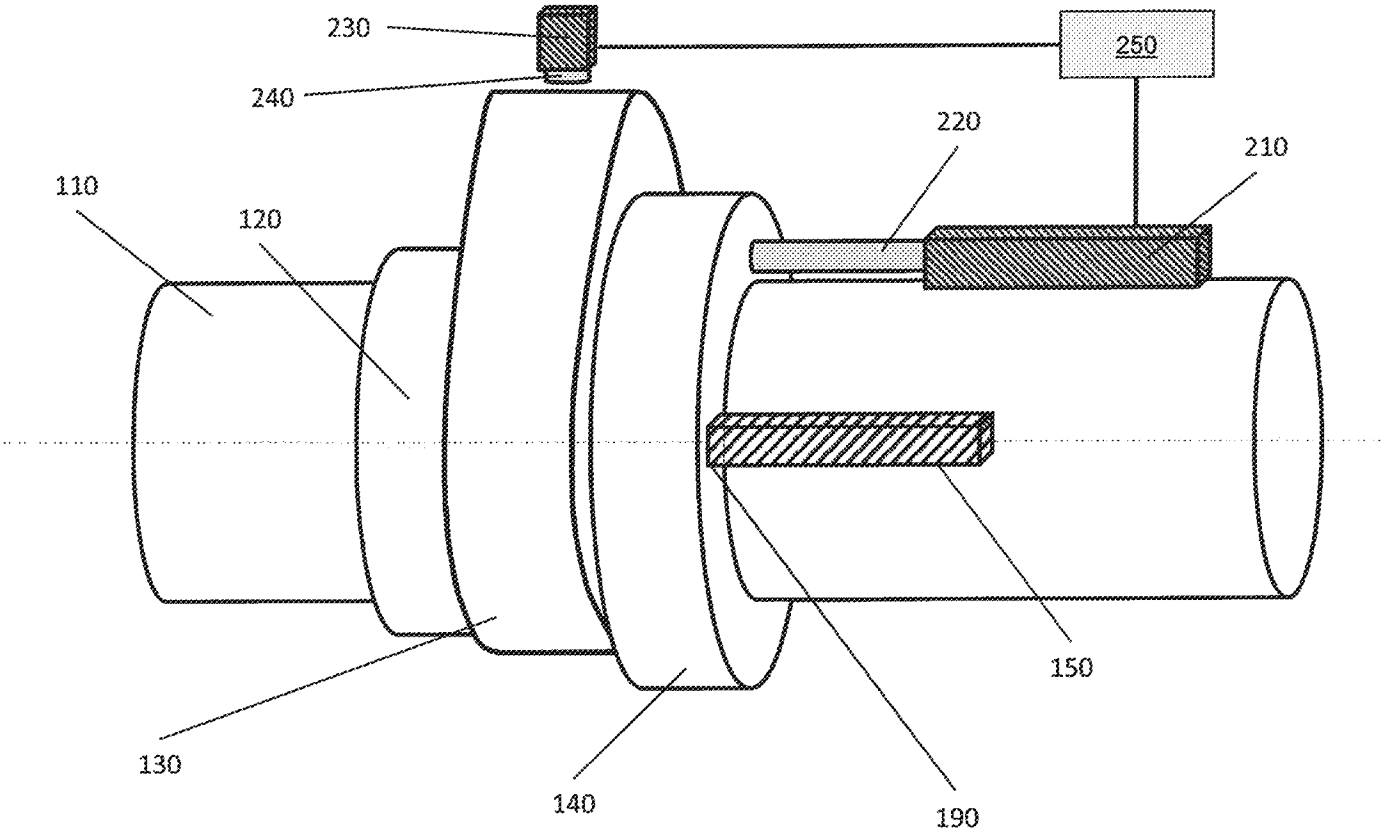
FIG. 4 illustrates an embodiment of an actuating dynamic locking and releasing cam lobe system.

FIG. 4 depicts the mechanism of FIG. 3 in an activated state, where the activation actuator 210, rotating with the camshaft 110 transmits force to the axially slidable disk 140 via an actuator arm 220. As depicted in FIG. 4, the cam lobe 130 is locked into place by the key 160 attached to the axially slidable disk 140 and fixes the rotation of the cam lobe 130 to the camshaft 110. In this state, the cam lobe is activated and functioning as in a conventional engine, and the valve(s) associated with this cam lobe 110 are active. This allows the particular valves fitted with this system to be activated very quickly and essentially at-will, in any engine cycle.

Thus, a system for allowing dynamic engagement or disengagement of a cam lobe on the camshaft is accomplished, allowing alignment between the camshaft 110 and the cam lobe 130 with an engagement at a specified angular relationship. This permits the cam lobe 130 to be "parked" when disengaged so that it is not rotating, preferably at an angle that allows some rotation of the cam lobe as engagement occurs prior to contact with the follower/roller. The system, therefore, may be activated or deactivated on a cycle-by-cycle basis, so that it may have n cycles on, and m cycles off, where n and m are integers greater or equal to 0.

The activation mechanism (activation actuator 210 and actuator arm 220) may be an electromagnetic clutch, an hydraulic actuator or an activating spring that forces the key 160 attached to or part of the axially slidable disk 140 to engage with keyway 170 on cam lobe 130 when key 160 and keyway 170 are aligned, thus ensuring valve operation is synchronized with camshaft 110 rotation. This system provides synchronization of the disengagement of the cam lobe 130 from the camshaft 110 and utilizes an arresting mechanism that prevents the rotation of the cam lobe when disengaged. Synchronization of the removal of the arresting mechanism may be accomplished simultaneous with the engagement of the cam lobe 130 with the camshaft 110.

A retention mechanism 240 may be utilized to hold or regulate the position of the cam lobe 130 at a particular position when it is inactivated or in a non-rotating state while camshaft 110 rotates. Such a mechanism may be flexible enough that re-engagement of the key 160 on the axially slidable disk 140 with keyway 170 on cam lobe 130 would allow essentially unhindered rotation of cam lobe 130 with camshaft 110. This would allow clocking of the relation between the key 160 and the keyway 170 providing greater precision and speed of the engagement.

The clocking mechanism (retention mechanism 240 may be activated by a clocking actuator 230) may also be an electromagnetic clutch, an hydraulic actuator or an activating spring that forces retention mechanism 240 to engage with the cam lobe 130 when the clocking actuator 230 is activated, thus ensuring that the cam lobe 130 and particularly the internal keyway 170 is positioned for engagement with the key 160 thereby assisting in the synchronization of the rotation of the axially slidable disk 140 with the cam lobe 130.

By example, an internal combustion engine (regardless of fuel type e.g., gasoline, diesel, or the like) utilizing a conventional cam driven reciprocating design may benefit from the selective removal, deactivation or interruption of one or a number of valves. When a vehicle is operating at low speed, low load, at idle conditions or other inefficient circumstances for a fully displaced internal combustion engine, deactivation of cylinders may improve the fuel economy. For instance, a vehicle with an 8 cylinder engine may receive benefit of increased fuel economy if only 4 cylinders of the internal combustion engine are operating during relatively low torque operating conditions by reducing throttling losses. The deactivated cylinders may also prevent gas exchange across the respective intake and exhaust valves, thereby reducing losses by enabling the engine to operate at a higher intake manifold pressure. By deactivating for instance, 4 of the cylinders during low torque demand modes of engine operation, the efficiency of the engine may be improved. Typically it may be preferred that alternating cylinders within the firing sequence of the engine be deactivated so that the engine balance is maintained.

The versatility of the above detailed system allows for a wide variety of deactivation schemes that can be tailored to specific engine load situations. These deactivation schemes and their selection based upon specific engine load situations may be controlled and implemented by a digital computer or programmable chips to selectively provide signals to control the operation of the actuators. Thus, an automated system that provides a dynamic locking and releasing cam lobe may be realized in the disclosed embodiments.

In an alternative embodiment, aligned pins are an alternative to a key and keyway. Aligned cylindrical cavities in both the cam lobe 130 and a feature fixed to the camshaft may be utilized so that pins may be engaged or disengaged by a combination of cylindrical pins and an oil supply controlled by a solenoid system. Such an oil supply might be introduced through the camshaft 110 and enter the camshaft feature. For instance, the actuator 210 may be accomplished by having oil routed through the camshaft 110 with separate drillings, and solenoid actuated, so that the actuator arm 220 is engaged in this manner. A sandwich type feature may be introduced on the camshaft 110 to ensure the cam lobe 130 does not move axially when the activation or spring force is applied to engage or disengage. It is desired that the cam lobe 130 not wander axially when disengaged. One way of ensuring this doesn't happen is to have the race 190 extend as far as cam lobe 130. The cam lobe 130 may require a locking device for appropriate orientation when disengaged to allow maximum, or near maximum rotation angle for secure engagement to occur prior to valve actuation.

This is because it is undesirable to have the cam lobe 130 resting against the follower when disengaged, since there is a potential for a mechanical shock to be realized when the cam lobe 130 is engaged with the camshaft. Additionally, the cam lobe 130, may not engage on the first attempt, especially if the signal to engage occurs when the key 160 and internal keyway 170 are nearly aligned. In this instance, there may be partial actuation of the valve, but not enough to achieve full operation. By allowing as much angular separation as possible between the attempt to engage the cam lobe 130 and the angle at which the cam lobe 130 operates the valve, a greater safety margin for proper valve operation is established.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The embodiments of the invention in which an exclusive property or privilege is claimed are defined as follows:

1. A cam driven reciprocating internal combustion engine comprising:

a cylinder block defining a plurality of cylinders, each said cylinder in mechanical communication with at least one of a respective cam driven intake valve and a respective exhaust valve;

a rotating camshaft in mechanical communication with at least one selectively disengagable cam lobe; said at least one selectively disengagable cam lobe that when mechanically coupled to said camshaft, controls the operation of at least one of said respective cam driven intake valve and said respective exhaust valve;

at least one coupler that selectively couples and decouples a rotational force of said camshaft to said at least one selectively disengagable cam lobe;

said at least one selectively disengagable cam lobe that is rotationally disengaged and uncoupled from rotation of said camshaft in a first mode thereby deactivating said respective cam driven intake valve, and said at least one selectively disengagable cam lobe that is rotationally engaged and coupled with respect to said rotation of said camshaft in a second mode thereby activating said at least one of said respective cam driven intake valve and said respective exhaust valve; and, a controller that sends a signal to said at least one coupler to rotationally disengage said at least one of said respective cam driven intake valve and said respective exhaust value during operation of said internal combustion engine.

2. A system for deactivating one or more valves of a reciprocating internal combustion engine during operation comprising:

a rotating camshaft in mechanical communication with a plurality of cam lobes, each of said plurality of cam lobes that is mechanically coupled to and controls the operation of at least one of an intake valve and an exhaust valve associated with a respective cylinder of said internal combustion engine;

at least one coupler that selectively couples a rotational force of said camshaft to said at least one respective cam lobe of said plurality of cam lobes;

at least one of said plurality of cam lobes that is selectively rotationally disengaged and uncoupled from rotation of said camshaft by said at least one coupler in a first mode thereby deactivating said at least one of an intake valve and an exhaust valve from undergoing gas exchange during at least one cycle of said operation of said internal combustion engine, and at least one of said plurality of cam lobes that is selectively rotationally engaged and coupled with respect to rotation of said camshaft by said at least one coupler in a second mode thereby activating said at least one of an intake valve and an exhaust valve to enable gas exchange during at least one cycle of said operation of said internal combustion engine; and, a controller that sends a signal to said at least one coupler to rotationally disengage said respective cylinder during operation of said internal combustion engine.

* * * * *